US005380643A

United States Patent [19]

Sasaki

[11] Patent Number: 5,380,643

[45] Date of Patent: Jan. 10, 1995

[54] SILVER HALIDE PHOTOGRAPHIC LIGHT-SENSITIVE MATERIAL

[75] Inventor: Takayuki Sasaki, Hino, Japan

[73] Assignee: Konica Corporation, Tokyo, Japan

[21] Appl. No.: 123,539

[22] Filed: Sep. 17, 1993

[30] Foreign Application Priority Data

Sep. 22, 1992 [JP] Japan ..... 4-253077

[51] Int. Cl.[6] ..... G03C 1/09; G03C 1/10

[52] U.S. Cl. ..... 430/575; 430/569; 430/583; 430/585; 430/604; 430/605

[58] Field of Search ..... 430/575, 583, 585, 569, 430/604, 605

[56] References Cited

U.S. PATENT DOCUMENTS 4,609,621 9/1986 Sugimoto et al. ..... 430/583
4,659,654 4/1987 Metoki et al. ..... 430/567
5,051,344 9/1991 Kuno .

FOREIGN PATENT DOCUMENTS 0096727 12/1983 European Pat. Off. .
0097720 1/1984 European Pat. Off. .
0415481 3/1991 European Pat. Off. .
0480294 4/1992 European Pat. Off. .

*Primary Examiner*—Thorl Chea
*Attorney, Agent, or Firm*—Frishauf, Holtz, Goodman & Woodward

[57] ABSTRACT

A silver halide photographic light-sensitive material in which silver halide grains contain rhodium salt and not more than 4 mol % of silver iodide, and at least one of spectral sensitizing dyes represented by formula 1 is added before the commencement of chemical ripening, is disclosed.

Formula 1

$Z_1$ and $Z_2$ represent ring forming groups with non-metallic atoms i.e. a pyrroline, thiazoline, thiazole, benzothiazole, naphthothiazole, selenazole, benzoselenazole, naphthoselenazole, oxazole, benzooxazole, naphthooxazole, imidazole, benzimidazole or a pyridine group. Each group is unsubstituted or substituted with a halogen atom, a lower alkyl group, a lower alkoxy group or a phenyl group; $R_1$ and $R_2$ each represent a lower alkyl group, a hydroxyalkyl group, a carboxylalkyl group or a sulfoalkyl group; $R_3$, when $n_3$ is 1, represents a lower alkyl group or a hydrogen atom, while, when $n_3$ is zero, represents a hydrogen atom; $n_1$ and $n_2$ each is 0 or 1; $n_3$ is 0 or 1; $X^-$ is an anion; and m is 1 or 2.

2 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and more particularly to a silver halide photographic light-sensitive material improved on its raw-stock preservability as well as on its handling characteristics (safelight safety characteristics).

BACKGROUND OF THE INVENTION

It is conventionally well-known that a water-soluble rhodium salt is used to obtain a contrast-increased photographic emulsion.

However, the water-soluble rhodium salt-used silver halide photographic light-sensitive material, although capable of forming a high-contrast image, has the disadvantage that it is liable to get increasingly fogged and to get its contrast reduced during its raw-stock storage.

As techniques to improve the raw-stock storage stability of a photographic light-sensitive material there are many techniques such as the use of cadmium compounds disclosed in U.S. Pat. No. 488,709, the use of nucleic acid-decomposed products disclosed in JP O.P.I. Nos. 23618/1950, the use of quinones or 3-pyrazolidones disclosed in JP O.P.I. Nos. 23383/1969, 11029/1977 and 154247/1985.

However, these conventional techniques are effective for low-speed silver chloride or silver chlorobromide emulsions, but, when applied to a high-speed silver iodobromide emulsion containing an appropriate amount of silver iodide, can not be deemed effective enough to prevent the emulsion from fogging and from contrast reduction during its storage, and in addition, have the problem that they are inferior in the safety to safelight that is essential for the safe handling of photographic films particularly in the darkroom, and thus a further improvement of them has been called for.

SUMMARY OF THE INVENTION

It is an object of the invention to provide a high-speed silver halide photographic light-sensitive material which is free from sensitivity drop and contrast reduction as well as from fogging during its raw-stock storage.

It is another object of the invention to provide a high-speed silver halide photographic light-sensitive material which is improved on its handling characteristics in the darkroom (safelight safety characteristics).

Other object of the invention will become apparent from the following descriptions.

The above objects of the invention can be accomplished by a silver halide photographic light-sensitive material which comprises a support having thereon at least one silver halide emulsion layer, in which the silver halide emulsion comprises silver iodobromide containing not more than 4 mol % silver iodide, and both a rhodium salt and at least one of spectral sensitizing dyes represented by the following Formula I are added at an arbitrary point of time before the commencement of the chemical ripening of the emulsion.

Formula I

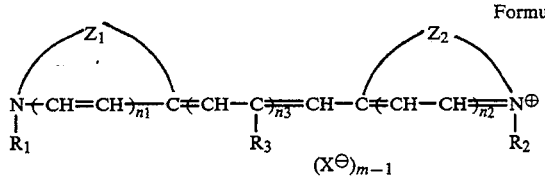

wherein $Z_1$ and $Z_2$ each represent a group of non-metallic atoms necessary to form a pyrroline ring, thiazoline ring, a thiazole ring, a benzothiazole ring, a naphthothiazole ring, a selenazole ring, a benzoselenazole ring, a naphthoselenazole ring, an oxazole ring, a benzoxazole ring, a naphthoxazole ring, imidazole ring, an imidazole ring, a benzoimidazole ring or a pyrimidine ring which each is unsubstituted or substitued with a halogen atom, a lower alkyl group, a lower alkoxy group or a phenyl group; $R_1$ and $R_2$ each represent a lower alkyl group, a hydroxyalkyl group, a carboxyalkyl group or a sulfoalkyl group; $R_3$, when $n_3$ is 1, represents a lower alkyl group or a hydrogen atom, while when $n_3$ is 0, represents a hydrogen atom; $n_1$ and $n_2$ each represent 0 or 1; $n_3$ represents 0 or 1; $X^-$ is an anion; and m is 1 or 2.

DETAILED DESCRIPTION OF THE INVENTION

The silver halide emulsion of the invention is characterized by adding both a rhodium salt and at least one of spectral sensitizing dyes represented by the foregoing Formula I thereto at a discretionary point of time during the period from the preparation of silver iodobromide grains through the process for desalting excessive salts until the beginning of the chemical ripening.

As the water-soluble rhodium salt used in the invention there are rhodium chloride, rhodium dichloride, rhodium trichloride and ammonium hexachlororhodate. As the ligand to the rhodium ion there may be used cyan, carbonyl, etc., but preferably a water-soluble trivalent rhodium's halogeno complex compounds such as sodium hexachlororhodate (III) or potassium hexabromorhodate (III).

The rhodium salt of the invention may be added at any discretional point of time as mentioned above, but, for better results of the invention, the addition should be made preferably either before completion of the desalting of the excessive salts following the grain preparation or before the chemical ripening following the completion of the desalting.

The adding amount of the water-soluble rhodium salt used in the invention is preferably $1\times10^{-11}$ to $1\times10^{-6}$ mol, and more preferably $1\times10^{-10}$ to $1\times10^{-9}$ mol per mol of the silver halide of the invention.

The spectral sensitizing dye of the foregoing Formula I of the invention may be added at any point of time before starting the chemical ripening of the silver halide emulsion of the invention as in the case of the above rhodium salt, but preferably in the course of the process between the desalting of excessive salts and the commencement of the chemical ripening.

Next, the spectral sensitizing dye of Formula I used in the invention is explained.

In Formula I, the groups of non-metallic atoms represented by $Z_1$ and $Z_2$ may be either the same as or different from each other to complete an azole ring, examples of which include a benzothiazole ring such as benzothiazole, 5-chlorobenzothiazole, 5-methylbenzothiazole, 5-methoxybenzothiazole, 5-hydroxybenzothiazole, 5-hydroxy-6-methylbenzothiazole, 5,6-dimethylbenzothiazole, 5-ethoxy-6-methylbenzothiazole, 5-phenylbenzothiazole, 5-carboxybenzothiazole, 5-ethoxycarbonylbenzothiazole, 5,6-dimethylaminobenzothiazole and 5-acetylaminobenzothiazole; a benzoselenazole ring such as benzoselenazole, 5-chlorobenzoselenazole, 5-methylbenzoselenazole, 5-methoxybenzoselenazole, 5-hydroxybenzoselenazole, 5,6-dimethylbenzoselenazole, 5,6-dimethoxybenzoselenazole, 5-ethoxy-6-methylbenzoselenazole, 5-hydroxy-6-methylbenzoselenazole and 5-phenylbenzoselenazole; a naphthothiazole ring such as β-naphthothiazole and β,β-naphthothiazole; a naphthoselenazole ring such as β-naphthoselenazole; a benzoxazole ring such as benzoxazole, 5-chlorobenzoxazole, 5-phenylbenzoxazole, 6-methoxybenzoxazole, 5-methylbenzoxazole and β,β-naphthoxazole; and a benzimidazole ring such as benzimidazole, 5-chlorobenzimidazole, 5,6-dichlorobenzimidazole, 5-methoxycarbonylbenzimidazole, 5-ethoxycarbonylbenzimidazole, 5-butoxycarbonylbenzimidazole and 5-fluorobenzimidazole.

Examples of the above $R_1$ or $R_2$ include alkyl groups such as methyl, ethyl and n-propyl groups; and substituted alkyl groups such as β-carboxyethyl, γ-carboxypropyl, γ-sulfopropyl, γ-sulfobutyl and sulfoethoxyethyl groups. Examples of the above $R_3$ include a hydrogen atom and methyl, ethyl and propyl groups.

Examples of the anion represented by the above X include a halogen ion, a perchloric acid ion, a thiocyanic acid ion, a benzenesulfonic acid ion, p-toluenesulfonic acid ion and a methylsulfuric acid ion.

The following are typical examples of the compound represented by Formula I used in the invention.

1

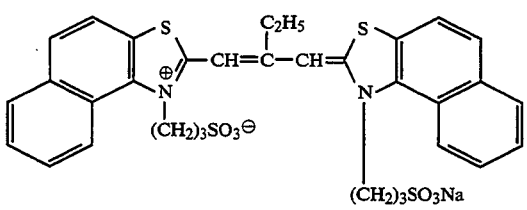

2

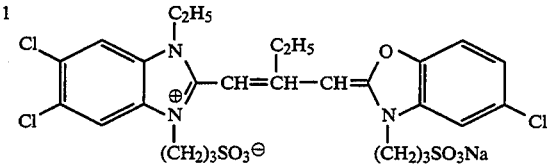

3

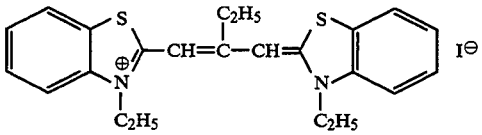

4

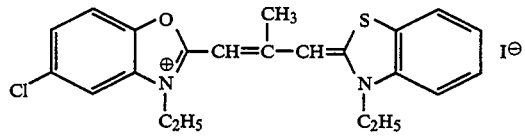

5

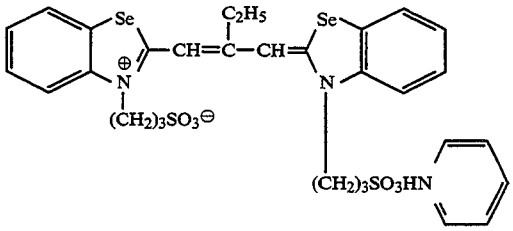

6

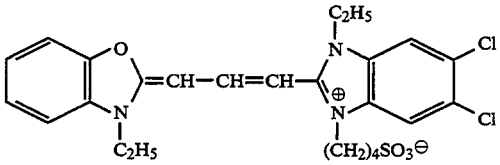

7

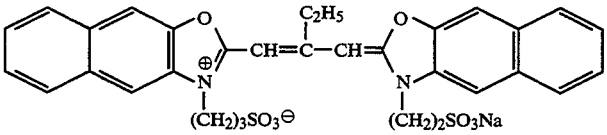

8

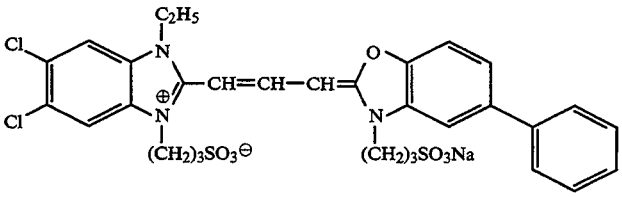

9

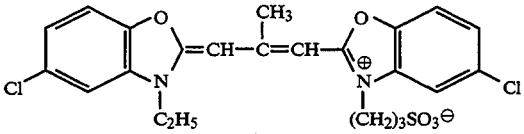

10

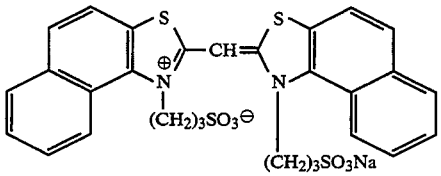

-continued
11
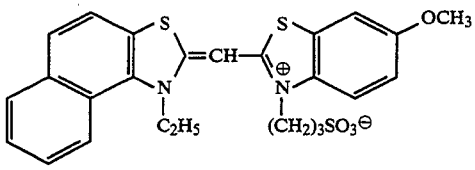
12
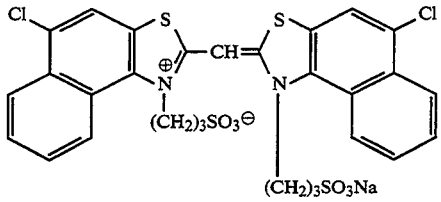
13
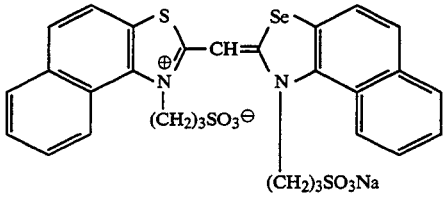
14
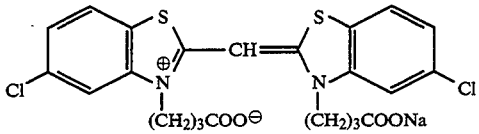
15
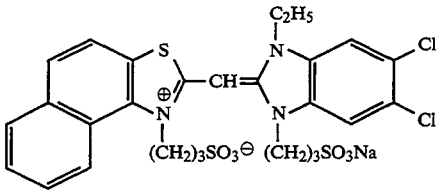
16
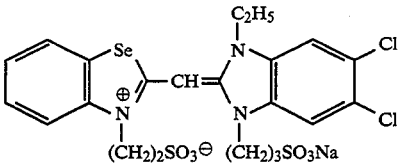
17
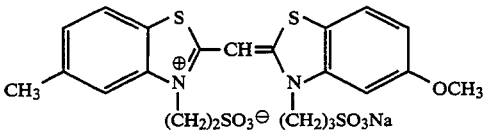
18
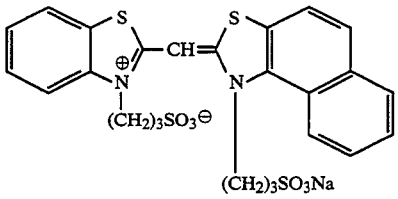
19
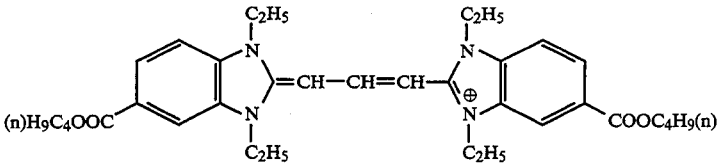
$I^{\ominus}$
20
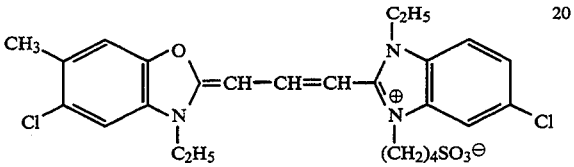
21
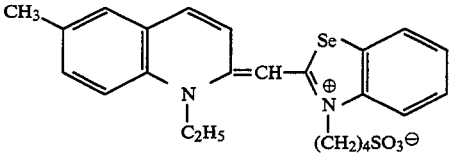
22
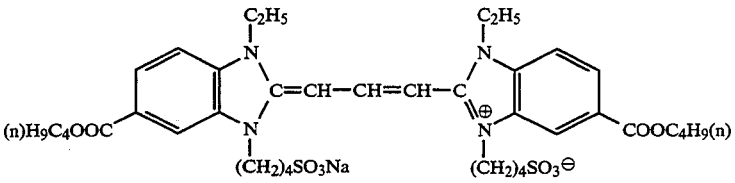
(23)
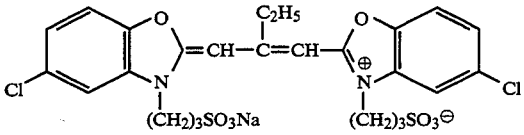
The above exemplified sensitizing dyes are the cyanine dyes described including their synthesis methods in F. M. Hamer, 'Heterocyclic-Compounds Cyanine Dyes and Related Compounds' John Wiley & Sons (New York, London) 1964.

The above spectral sensitizing dyes may be used alone or in combination to be added according to the method of the invention in order to obtain desired spectral sensitivities.

The adding amount of the dyes of Formula I, although not definite depending upon the kind thereof and conditions of the emulsion used, is preferably 3 to 1500 mg, more preferably 60 to 1000 mg per mol of silver halide.

The silver halide emulsion of the invention is a high-speed silver iodobromide emulsion having an average silver iodide content of not more than 4 mol %, preferably 1.0 to 3.5 mol %, and more preferably 1.5 to 2.5 mol %.

The silver halide grain used in the invention may be of any crystal form, including regular crystal forms such as cubic, octahedral and tetradecahedral crystals, and twin crystal grains of various forms.

The emulsion used in the silver halide photographic light-sensitive material of the invention may be prepared in accordance with various methods, such as the method described in T. H. James, 'The Theory of the Photographic Process' 4th ed., Macmillan (1977) pp. 38–104; those methods described in G. F. Duffin, 'Photographic Emulsion Chemistry,' Focal Press (1966), P. Glafkides, 'Chimie et Physique Photographique' Paul Montel (1967), and V. L. Zelikman et al, 'Making and Coating Photographic Emulsion' Focal Press (1964).

Namely, the emulsion can be prepared by an appropriate combined use of the following processes: the use of silver and halide solutions for acidic, ammoniacal or neutral process to form an emulsion in a precipitation process such as normal precipitation, reverse precipitation, double-jet or controlled double-jet process, along with a grain preparation process such as conversion or core/shell process.

The silver halide grain may be either a fine grain having a diameter of not more than 0.1 μm or a large grain having a diameter of up to 10 μm, and the emulsion may be either a monodisperse emulsion having a narrow grain size distribution or a polydisperse emulsion having a broad grain size distribution. The monodisperse emulsion herein means a silver halide emulsion whose silver halide grains diameters' coefficient of variation defined in JP O.P.I. No. 162244/1985 is not more than 0.20.

The monodisperse emulsion may be an emulsion comprising silver halide grains whose average grain diameter is not less than 0.1 μm and at least 95% by weight of which are within the range of the average grain diameter ±40%. There may also be used an emulsion of silver halide grains having an average grain diameter of 0.25 μm to 2 μm, at least 95% by weight of which are within the range of the average grain diameter ±20%.

The above monodisperse emulsion can be prepared by known methods, which are detailed in Phot. Sci., 12. 242–251 (1963), JP O.P.I. Nos. 36890/1973, 16364/1977, 142329/1980 and 49938/1983, British Patent No. 1,413,748, and U.S. Pat. Nos. 3,574,628 and 3,655,594.

As the emulsion for the silver halide photographic light-sensitive material of the invention there may be used an emulsion obtained by a method in which, to obtain a monodisperse emulsion, e.g., seed crystal grains are used as growing nucleus, and grown by providing silver ions and halide ions thereto.

The silver halide grain may be of a non-uniform crystal structure with difference in the silver halide composition between the inside and the outside thereof, or may also be of a stratified structure. The most preferred embodiment of it is the silver halide grain of a structure distinctly stratified with substantial two phases: a high-silver-iodide content core phase and a low-silver-iodide content shell phase (core/shell structure).

The silver iodide content of the core phase is preferably 20 to 40 mol %, and more preferably 20 to 30 mol %.

The silver halide composition other than the silver iodide pf the core may be either silver bromide or silver chlorobromide, but is preferably a composition composed mainly of silver bromide.

The outermost shell phase is a silver halide having a silver iodide content of preferably not more than 5 mol %, and more preferably not more than 2 mol %. The silver halide other than the silver iodide of the outermost phase may be any one of silver chloride, silver bromide and silver chlorobromide, but is preferably a silver bromide-dominant composition.

For the preparation of the above core/shell-type emulsion reference can be made to the relevant methods described in J. Phot. Sci., 24. 198 (1976); U.S. Pat. Nos. 2,592,250, 3,505,068, 4,210,450 and 4,444,877; and JP O.P.I. No. 143331/1960.

The emulsion, in order to remove the soluble salts therefrom, may be subjected to noodle-washing or flocculation treatment. Preferred desalting methods include the method of using a sulfo group-containing aromatic hydrocarbon aldehyde resin described in JP E.P. No. 16086/1960, and the use of the exemplified high-molecular flocculant Compounds G-3, G-8, etc., disclosed in JP O.P.I. No. 158644/1988.

The emulsion used in the silver halide photographic light-sensitive material of the invention may have various photographic additives added thereto before or after its physical or chemical ripening process.

As the above-mentioned photographic additives there may be used those compounds as described in RD-17643, RD-18716 and RD-308119 (Dec. 1989), in which the kinds of the compounds described and the sections and pages relevant thereto are as follows:

| | RD-17643 | | RD-18716 | RD-308119 | |
|---|---|---|---|---|---|
| Additive | Page | Sec. | Page | Page | Sec. |
| Chemical sensitizers | 23 | III | 648 upper right | 996 | III |
| Sensitizing dyes | 23 | IV | 648–649 | 996–8 | IV |
| Desensitizers | 23 | IV | | 998 | B |
| Dyes | 25–26 | VIII | 649–650 | 1003 | VIII |
| Development accelerators | 29 | XXI | 648 upper right | | |
| Antifoggants, stabilizers | 24 | IV | 649 upper right | 1006–7 | VI |
| Brightening agents | 24 | V | | 998 | V |
| Hardeners | 26 | X | 651 Left | 1004–5 | X |
| Surfactants | 26–27 | | 650 Right | 1005–6 | XI |
| Plasticizers | 27 | XII | 650 Right | 1006 | XII |

-continued

| Additive | RD-17643 Page | RD-17643 Sec. | RD-18716 Page | RD-308119 Page | RD-308119 Sec. |
|---|---|---|---|---|---|
| Sliding agents | 27 | XII | | | |
| Matting agents | 28 | XVI | 650 Right | 1008–9 | XVI |
| Binders | 26 | XXII | | 1003–4 | IX |
| Support materials | 28 | XVII | | 1009 | XVII |

As the support for the silver halide photographic light-sensitive material of the invention there may be used those materials described in the above RD publications, appropriate ones among which are plastic films. The support may have its surface either provided with a subbing layer or subjected to corona discharge treatment, UV irradiation treatment, and the like.

The hydrophilic colloid layer of the silver halide photographic light-sensitive material of the invention covers all the component layers of the light-sensitive material ranging from the light-sensitive and substantially non-light-sensitive silver halide emulsion layers to auxiliary layers such as protective layer, intermediate layer, filter layer, UV aborbing layer, antihalation layer and backing layer.

As the binder or protective colloid for the hydrophilic colloid layer of the invention there may be used not only gelatin but also various high-polymer compounds.

As the above-mentioned gelatin there can be used lime-treated gelatin, acid-treated gelatin or gelatin derivatives. Useful examples of the non-gelatin synthetic high-polymer compound include cellulose derivatives such as hydroxyethyl cellulose, homo- or co-polymers of polyvinyl alcohol, polyvinyl alcohol partial acetal, poly-N-vinyl pyrrolidone, polyacrylic acid, polyacrylamide and the like.

The light sensitive material of the invention may be processed by using those processing solutions as described in, e.g., RD-17643 XX-XXI, pp. 29–30, or RD-308119 XX-XXI, pp. 1011–1012. The processing may be either a black-and-white photographic processing to form a silver image or a color photographic processing to form a dye image. The processing is made usually at a temperature of from 18° C. to 50° C.

Examples of the developer for black-and-white photographic processing include dihydroxybenzenes such as hydroquinone, 3-pyrazolidones such as 1-phenyl-3-pyrazolidone, aminophenols such as N-methyl-p-aminophenol, and the like, which may be used alone or in combination. With the developer there may be used at need known additives such as a preservative, alkali agent, pH buffer, antifoggant, hardener, development accelerater, surfactant, defoaming agent, toning agent, water softener, dissolution assistant, viscosity-providing agent and the like.

In the fixing bath, a fixing agent such as a thiosulfate or a thiocyanate is used, and it may also contain a water-soluble aluminum salt as a hardener, such as aluminum sulfate or potassium alum, and in addition, a preservative, pH adjusting agent and water softener.

Examples of the silver halide photographic light-sensitive material to which the invention is applicable include high-speed black-and-white photographic light-sensitive materials such as light-sensitive materials for X-ray photography use, black-and-white negative films for camera use, micrographic films and light-sensitive materials for silver halide diffusion transfer process use.

EXAMPLES

Example 1

Preparation of Inventive Emulsion

A 2 mol % silver iodide-containing silver iodobromide monodisperse cubic crystal grains emulsion having an average grain diameter of 0.29 μm was prepared by a double-jet process with pAg and pH being controlled to 8 and 2.0, respectively, at 60° C.

The emulsion prepared in above was found from its electron microscopic photo to have a twin crystal generation rate of not more than 1% by number. This emulsion was used as seed crystals for growing silver halide grains as follows.

With pAg being maintained 9.0 constant, pH was changed from 9 to 8 in proportion to the added amount of ammoniacal silver ions. The obtained grains each had silver iodide distributed throughout the whole grains, having an average silver iodide content of 1.7 mol %, an average grain diameter of 0.65 μm, and a coefficient of variation, representing its monodispersibility, of 0.12. This emulsion was designated as Emulsion C.

The above seed crystals were dispersed in 8.5 liters of a protective gelatin aqueous solution, at need containing ammonia, kept at a temperature of 40° C., and pH of it was adjusted with acetic acid. To this as a mother liquid was added a 3.2N ammoniacal silver ion aqueous solution according to the double-jet process.

In this instance, pH and pAg were changed from time to time depending on changes in the silver iodide content and crystal habit.

Namely, pAg and pH were controlled to 7.3 and 9.7 respectively, and a 35 mol % silver iodide content-having phase was formed.

Afterward, pH was changed from 9 to 8 and a silver bromide phase was formed. In this instance, pAg was kept at 9.0 until 90% of the grain diameter, then a potassium bromide solution was added though a nozzle to lower pAg to 11.0, the mixing was completed three minutes after the completion of the addition of potassium bromide, and pH of the liquid was adjusted to 6.0 with acetic acid.

Of the above-obtained emulsion, a part having an average silver iodide content of 1.7 mol % was designated as Emulsion A, and another part having an average iodide content of 3.0 mol % was designated as Emulsion B. Both emulsions were of monodisperse grains having an average grain diameter of 0.65 μm.

Another emulsion prepared in the same manner as in the above, having an average silver iodide content of 2.2 mol %, and an average grain diameter of 0.40 μm, was designated as Emulsion D.

Further, as a comparative emulsion an emulsion having an average silver iodide content of 5 mol % and an average grain diameter of 0.65 μm was prepared, which was designated as Emulsion E.

At the time of the preparation of each emulsion, a rhodium salt (potassium hexabromorhodate(III)) was added in amounts and in stages as specified in Tables 1, 2 and 3. Regarding the adding stage, the addition of the salt to the halide solution when growing grains was designated as (A), before the desalting following the completion of the mixing as (B), and before starting the chemical ripening (upon reaching the chemical ripening temperature) as (C). Where the salt was added to the coating liquid for comparison was designated as (D), provided the Emulsion D is free of the rhodium salt.

As for the spectral sensitizing dye, exemplified Compounds (23) and (22) were separately dissolved in a mixture of methanol and glycerol, and the respective solutions were added so as to come to 340 mg and 3 mg, respectively, per mol of silver halide in stages as shown in Tables 1 to 3. Regarding the adding stage, the adding before the desalting following the completion of the mixture was designated as (A) and before the chemical ripening following the completion of the desalting as (B).

Where for comparison the sensitizing dyes were added after the addition of potassium iodide following the completion of the chemical ripening (after KI conversion), it was designated as (C). The addition of the dyes to Emulsion D was made before the chemical ripening following the desalting.

With regard to the above desalting, the emulsion after the grain preparation was kept at 40° C. and desalted by using an aqueous solution of Demol N (sodium naphthalenesulfonatealdehyde condensate), produced by Kawo Atlas Co., and magnesium sulfate, and then redispersed into an aqueous gelatin solution to thereby complete the desalting of the emulsion.

The desalted emulsion was subjected to chemical ripening treatment. Namely, the emulsion, kept at 55° C. was chemically ripened by adding appropriate amounts of chloroauric acid, sodium thiosulfate and ammonium thiocyanate. Fifteen minutes before completion of the ripening, potassium iodide in an amount of 200 mg per mol of silver halide, and 4-hydroxy-6-methyl-1,3,3a,7-tetrazaindene in an amound of $3\times10^{-2}$ mol per mol of silver halide were added, and then then the emulsion was dispersed in an aqueous solution containing 70 g of gelatin.

To each of the obtained emulsions the following additives were added. The following added amounts of them are indicated in weights per mol of silver halide.

| | |
|---|---|
| 1,1-Dimethylol-1-bromo-1-nitromethane | 70 mg |
| t-Butyl-catechol | 400 mg |
| Polyvinylpyrrolidone (molecular weight: 10,000) | 1.0 g |
| Styrene-maleic anhydride copolymer | 2.5 g |
| Nitrophenyl-triphenylphosphonium chloride | 50 mg |
| Trimethylol propane | 10 g |
| Ammonium 1,3-dihydroxybenzene-4-sulfonate | 4 g |
| Sodium 2-mercaptobenzimidazol-5-sulfonate | 15 mg |
| $C_4H_9OCH_2CH(OH)CH_2N(CH_2COOH)_2$ | 1 g |
| 1-Phenyl-5-mercaptotetrazole | 10 mg |
| 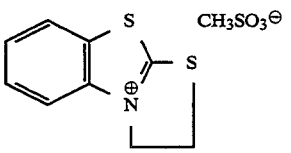 | 35 mg |

-continued

| | |
|---|---|
| 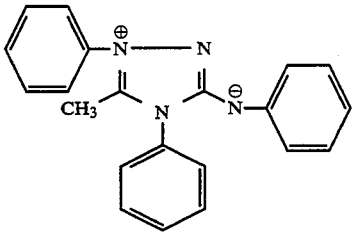 | 60 mg |
| *Dye emulsification dispersion | 1.2 g |

The additives added to the protective layer are as follows: The added amounts are indicated in amounts per liter of the coating liquid.

| | |
|---|---|
| Lime-treated inert gelatin | 68 g |
| Acid-treated gelatin | 2 g |
| Sodium i-amyl-n-decylsulfosuccinate | 0.3 g |
| Polymethyl methacrylate (matting agent, having an area average particle diameter of 3.5 μm) | 1.1 g |
| Silicon dioxide particles (matting agent, having an area average particle diameter of 1.2 μm) | 0.5 g |
| Ludox AM (produced by DuPont Co.) (colloidal silica) | 30 g |
| 2% aqueous solution of sodium 2,4-dichloro-6-hydroxy-1,3,5-triazine (hardener) | 10 ml |
| 40% aqueous solution of glyoxal (hardener) | 1.5 ml |
| $(CH_2{=}CHSO_2CH_2)_2O$ (hardener) | 500 mg |
| S-1 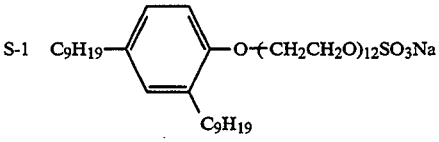 | 1.0 g |
| S-2 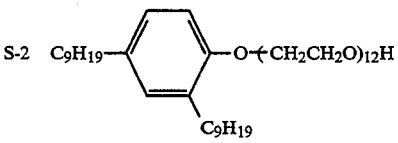 | 0.4 g |
| 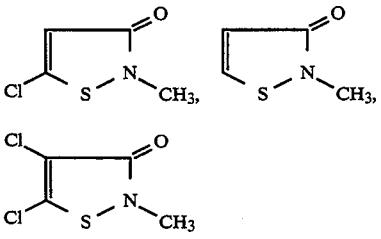 (50:46:4) | 0.1 g |
| S-3 $NaO_3S{-}CH(CH_2COOCH_2(C_2F_4)_3H)COOCH_2(C_2F_4)_3H$ | 0.5 g |
| S-4 $C_{12}H_{25}CONH(CH_2CH_2O)_5H$ | 2.0 g |

*The dye emulsification dispersion was prepared as follows.

Ten kilograms of the following dye were weighed out and dissolved in a mixture solvent at 55° C. comprised of 28 liters of tricresyl phosphate and 85 liters of ethyl acetate to form its solution, which is referred to as an oily solution. On the other hand, 1.35 kg of an anionic surfactant (the following AS) were dissolved in an aqueous 9.3% gelatin solution at 45° C. to form 270 ml of its solution, which is referred to as an aqueous solution.

The above oily and aqueous solutions were put together in a dispersing kettle, in which the mixed liquid was dispersed at a temperature maintained 40° C. constant.

The obtained dispersion, after adding 8 g of the following additive C, 16 liters of an aqueous 2% phenol solution, and water thereto to make the whole 240 kg, was cooled to be solidified.

Dye

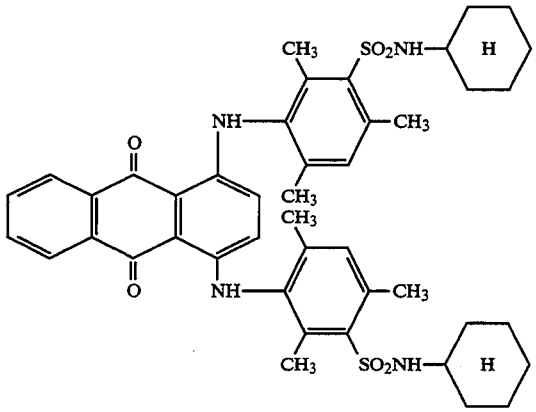

AS

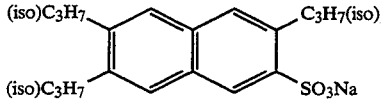

C

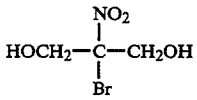

In order to provide a backing layer on the backing side, the following liquid was prepared.

| Backing layer | Amt per liter |
|---|---|
| Backing lower layer coating liquid: | |
| Lime-treated gelatin | 70 g |
| Acid-treated gelatin | 5 g |
| Trimethylol propane | 1.5 g |
| Backing dye A | 1.0 g |
| Backing dye B | 1.0 g |
| Backing dye C | 1.0 g |
| Glyoxazal, 40% solution | 8 ml |
| Backing upper layer coating liquid: | |
| Lime-treated gelatin | 70 g |
| Acid-treated gelatin | 5 g |
| Trimethylol propane | 1.5 g |
| Backing dye A | 1.0 g |
| Backing dye B | 1.0 g |
| Potassium nitrate | 0.5 g |
| Polymethyl methacrylate (area average particle diameter: 3.5 μm) | 1.1 g |
| Sodium di-2-ethylhexylsulfosuccinate | 0.4 g |
| Sodium 2,4-dichloro-6-hydroxy-1,3,5-triazine 2% solution (hardener) | 10 ml |
| S-1 | 1.0 g |
| S-3 | 0.3 g |
| S-4 | 2.0 g |

Backing dye A

-continued

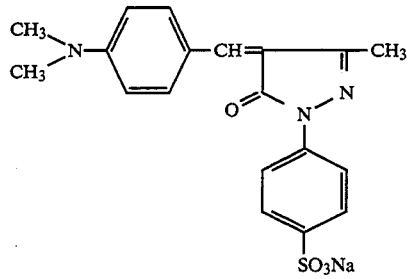

Backing dye B

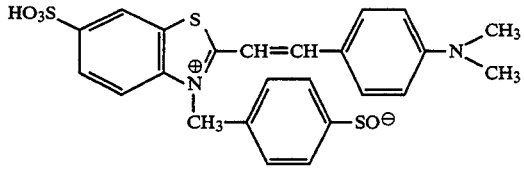

Backing dye C

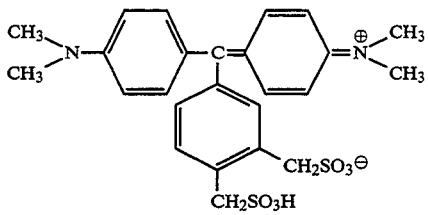

Simultaneous coatings on both sides of a film base were made by means of two slidehopper-type coaters; i.e., one coater was used to coat both emulsion and protective layers simultaneously so as to make the emulsion have coating weights of silver and gelatin of 5.0 g/m$^2$ and 3.4 g/m$^2$, respectively, and so as to make the protective layer have a gelatin coating weight of 1.15 g/m$^2$, while the other was used to coat the backing lower and upper layers simultaneously so as to make gelatin coating weights of 3.6 g/m$^2$ and 1.5 g/m$^2$, respectively, at a coating speed of 90 meters per minute on a polyethylene terephthalate film of 175 μm in thickness subbed with an aqueous copolymer dispersion obtained by diluting a tricomponent copolymer composed of glycidyl methacrylate(50 wt %), methyl acrylate(10 wt %) and butyl methacrylate(40 wt %) so as to make its concentration 10 wt %. The coated film was dried for 2 minutes and 15 seconds, whereby a sample was obtained.

Sensitometry

The obtained sample, with its one side in contact with a fluorescent screen M-100 (a product of KONICA Corp.), was loaded in a KONICA Mammography casette to be exposed for 0.1 second at different distances to X-rays from Mo tube voltage 30 kvp, 100 mA, to prepare sensitometric curves, whereby sensitivity and gamma characteristics were obtained.

The sensitivity is expressed as reciprocal of the X-ray dose necessary to obtain a fog+1.0 density, and in the table, it is indicated with a relative speed to the sensitivity of the reference sample set at 100. The gamma is expressed as reciprocal of the difference in the logarithm of the reciprocal of the X-ray dose necessary to give a fog+0.2 density. The processing of the film was made in an automatic processor SRX-501, manufactured by KONICA Corp., by using a developer solution and a fixer solution of the following compositions, wherein the overall processing period of time was 90 seconds.

| Processing step | Temperature (°C.) | Time (sec.) | Repl. amt. |
|---|---|---|---|
| Insert | — | 1.2 | |
| Developing + crossover | 35 | 14.6 | 33 cc/10 × 12 in |
| Fixing + crossover | 33 | 8.2 | 63 cc/10 × 12 in |
| Washing + crossover | 18 | 7.2 | 3.5 liters/min. |
| Squeeze | 40 | 5.7 | |
| Drying | 45 | 8.1 | |
| Total | — | 45.0 | |

| Developer | |
|---|---|
| Potassium sulfite | 70 g |
| Trisodium hydroxyethylethylenediamine-triacetic acid | 8 g |
| 1,4-Dihydroxybenzene | 28 g |
| Boric acid | 10 g |
| 5-Methylbenzotriazole | 0.04 g |
| 1-Phenyl-5-mercaptotetrazaole | 0.01 g |
| Sodium metabisulfite | 5 g |
| Acetic acid (90%) | 13 9 |
| Triethylene glycol | 15 g |
| 1-Phenyl-3-pyrazolidone | 1.2 g |
| 5-Nitroindazole | 0.2 g |
| Glutaraldehyde | 4 g |
| Potassium bromide | 4 g |
| 5-Nitrobenzimidazole | 1 g |

-continued

| | |
|---|---|
| Water to make one liter. | |
| Adjust pH to 10.5 with sodium hydroxide. | |
| Fixing bath | |
| Sodium thiosulfate, pentahydrate | 4.5 g |
| Disodium ethylenediaminetetraacetate | 0.5 g |
| Ammonium thiosulfate | 150 g |
| Anhydrous sodium sulfite | 8 g |
| potassium acetate | 16 g |
| Aluminum sulfate, deca- to octadeca-hydrate | 10 g |
| sulfuric acid (50 wt %) | 5 g |
| Citric acid | 1 g |
| Boric acid | 7 g |
| Glacial acetic acid | 5 g |
| Water to make one liter. | |
| Adjust pH to 4.2 with glacial acetic acid. | |

In order to prepare aging raw-stock samples, film sheets were superposed with the emulsion side in close contact with the backing side thereof to be stored under conditions of temperature of 23° C. and relative humidity of 48%.

Safelight Safety Characteristics

The sample film was exposed at a distance of one meter to HIGHLIGHT, a light through a red safelight filter, manufactured by KONICA Corp., and then processed in the same manner as in the case of the sensitometry test. The difference between the values obtained by subtracting fog densities from the respective densities of the unexposed sample and the sample exposed for 20 minutes are indicated as ΔD in the following tables.

TABLE 1

| Sample No. | Emulsion used | Rhodium salt: Added amt (mol/mol AgX) | Rhodium salt: Added stage | Sensitizing dye added stage | Sensitivity (rel. speed) | Contrast: 3 days after coating | Contrast: 60 days after coating | Fog: 3 days after coating | Fog: 60 days after coating | Safelight safety characteristics ΔD |
|---|---|---|---|---|---|---|---|---|---|---|
| 1 (Inv.) | A | $5.0 \times 10^{-10}$ | A | A | 0.90 | 2.66 | 2.62(−0.04) | 0.04 | 0.04( 0.00) | 0.08 |
| 2 (Inv.) | A | " | A | B | 0.95 | 2.70 | 2.68(−0.02) | 0.04 | 0.04( 0.00) | 0.06 |
| 3 (Comp.) | A | " | A | C | 0.74 | 2.57 | 2.21(−0.26) | 0.04 | 0.08(+0.04) | 0.30 |
| 5 (Inv.) | A | " | B | A | 0.95 | 2.65 | 2.63(−0.02) | 0.03 | 0.03( 0.00) | 0.06 |
| 6 (Inv.) | A | " | B | B | 1.00 (ref.) | 2.70 | 2.68(−0.02) | 0.03 | 0.03( 0.00) | 0.04 |
| 7 (Comp.) | A | " | B | C | 0.80 | 2.58 | 2.38(−0.20) | 0.03 | 0.05(+0.02) | 0.21 |
| 9 (Inv.) | A | " | C | A | 1.01 | 2.55 | 2.53(−0.02) | 0.03 | 0.03( 0.00) | 0.05 |
| 10 (Inv.) | A | " | C | B | 1.05 | 2.60 | 2.59(−0.01) | 0.03 | 0.03( 0.00) | 0.04 |
| 11 (Comp.) | A | " | C | C | 0.84 | 2.47 | 2.27(−0.20) | 0.03 | 0.05(+0.02) | 0.20 |
| 13 (Comp.) | A | " | D | A | 1.16 | 2.29 | 2.25(−0.04) | 0.04 | 0.05(+0.01) | 0.28 |
| 14 (Comp.) | A | " | D | B | 1.20 | 2.28 | 2.25(−0.03) | 0.03 | 0.03( 0.00) | 0.25 |
| 15 (Comp.) | A | " | D | C | 1.16 | 2.29 | 2.26(−0.03) | 0.03 | 0.06(+0.03) | 0.28 |

*Each parenthesized number is the difference between the values obtained 3 days and 60 days after coating.

TABLE 2

| Sample No. | Emulsion used | Rhodium salt: Added amt (mol/mol AgX) | Rhodium salt: Added stage | Sensitizing dye added stage | Sensitivity (rel. speed) | Contrast: 3 days after coating | Contrast: 60 days after coating | Fog: 3 days after coating | Fog: 60 days after coating | Safelight safety characteristics ΔD |
|---|---|---|---|---|---|---|---|---|---|---|
| 17 (Comp.) | A | $5.0 \times 10^{-8}$ | B | A | 0.58 | 3.65 | 3.63(−0.02) | 0.03 | 0.04( 0.01) | 0.07 |
| 18 (Inv.) | A | " | B | B | 0.60 | 3.70 | 3.69(−0.10) | 0.03 | 0.03( 0.00) | 0.07 |
| 19 (Comp.) | A | " | B | C | 0.50 | 3.45 | 3.17(−0.28) | 0.04 | 0.08(+0.04) | 0.31 |
| 21 (Inv.) | A | $5.0 \times 10^{-9}$ | B | A | 0.75 | 2.90 | 2.88(−0.02) | 0.03 | 0.03( 0.00) | 0.05 |
| 22 (Inv.) | A | " | B | B | 0.80 | 3.00 | 2.99(−0.01) | 0.03 | 0.03( 0.00) | 0.04 |
| 23 (Comp.) | A | " | B | C | 0.60 | 2.81 | 2.60(−0.21) | 0.03 | 0.07(+0.04) | 0.22 |
| 25 (Inv.) | A | $5.0 \times 10^{-10}$ | B | A | 0.95 | 2.65 | 2.63(−0.02) | 0.03 | 0.03( 0.00) | 0.06 |
| 26 (Inv.) | A | " | B | B | 1.00 (ref.) | 2.70 | 2.68(−0.02) | 0.03 | 0.03( 0.00) | 0.04 |
| 27 (Comp.) | A | " | B | C | 0.80 | 2.58 | 2.38(−0.20) | 0.03 | 0.05(+0.02) | 0.21 |
| 29 (Inv.) | A | $1.0 \times 10^{-11}$ | B | A | 2.40 | 2.40 | 2.39(−0.01) | 0.03 | 0.03( 0.00) | 0.07 |
| 30 (Inv.) | A | " | B | B | 2.40 | 2.40 | 2.40(−0.00) | 0.03 | 0.03( 0.00) | 0.08 |
| 31 (Comp.) | A | " | B | C | 2.20 | 2.20 | 2.08(−0.12) | 0.03 | 0.05(+0.02) | 0.34 |
| 33 (Inv.) | A | $1.0 \times 10^{-12}$ | B | A | 1.30 | 2.01 | 2.01( 0.00) | 0.03 | 0.03( 0.00) | 0.08 |
| 34 (Inv.) | A | " | B | B | 1.32 | 2.00 | 2.01( 0.00) | 0.03 | 0.03( 0.00) | 0.09 |

TABLE 2-continued

| Sample No. | Emulsion used | Rhodium salt Added amt (mol/mol AgX) | Rhodium salt Added stage | Sensitizing dye added stage | Sensitivity (rel. speed) | Contrast 3 days after coating | Contrast 60 days after coating | Fog 3 days after coating | Fog 60 days after coating | Safelight safety characteristics ΔD |
|---|---|---|---|---|---|---|---|---|---|---|
| 35 (Comp.) | A | " | B | C | 1.21 | 1.82 | 1.71(−0.11) | 0.03 | 0.04(+0.01) | 0.39 |

TABLE 3

| Sample No. | Emulsion used | Rhodium salt Added amt (mol/mol AgX) | Rhodium salt Added stage | Sensitizing dye added stage | Sensitivity (rel. speed) | Contrast 3 days after coating | Contrast 60 days after coating | Fog 3 days after coating | Fog 60 days after coating | Safelight safety characteristics ΔD |
|---|---|---|---|---|---|---|---|---|---|---|
| 37 (Inv.) | A | $5.0 \times 10^{-10}$ | B | A | 0.95 | 2.65 | 2.63(−0.02) | 0.03 | 0.03( 0.00) | 0.06 |
| 38 (Inv.) | A | " | B | B | 1.00 (ref.) | 2.70 | 2.68(−0.02) | 0.03 | 0.03( 0.00) | 0.04 |
| 39 (Comp.) | A | " | B | C | 0.80 | 2.58 | 2.38(−0.20) | 0.03 | 0.05(+0.02) | 0.21 |
| 41 (Inv.) | B | " | B | A | 1.05 | 2.45 | 2.41(−0.04) | 0.04 | 0.05(+0.02) | 0.09 |
| 42 (Inv.) | B | " | B | B | 1.10 | 2.50 | 2.47(−0.03) | 0.04 | 0.04( 0.00) | 0.08 |
| 43 (Comp.) | B | " | B | C | 0.91 | 2.32 | 2.06(−0.26) | 0.04 | 0.08(+0.04) | 0.41 |
| 45 (Inv.) | C | " | B | A | 0.86 | 2.60 | 2.58(−0.02) | 0.03 | 0.04( 0.01) | 0.08 |
| 46 (Inv.) | C | " | B | B | 0.90 | 2.70 | 2.69(−0.01) | 0.03 | 0.05(+0.02) | 0.08 |
| 47 (Comp.) | C | " | B | C | 0.82 | 2.50 | 2.29(−0.21) | 0.03 | 0.08(+0.05) | 0.39 |
| 49 (Inv.) | A + D | " | B | A | 0.97 | 2.55 | 2.54(−0.01) | 0.03 | 0.03( 0.00) | 0.05 |
| 50 (Inv.) | " | " | B | B | 1.01 | 2.60 | 2.60( 0.00) | 0.03 | 0.03( 0.00) | 0.05 |
| 51 (Comp.) | " | " | B | C | 0.82 | 2.49 | 2.29(−0.20) | 0.03 | 0.05(+0.02) | 0.20 |
| 53 (Comp.) | E | " | B | A | 1.15 | 2.35 | 2.24(−0.11) | 0.03 | 0.06(+0.03) | 0.14 |
| 54 (Comp.) | E | " | B | B | 1.20 | 2.40 | 2.25(−0.14) | 0.03 | 0.06(+0.03) | 0.16 |

*Sample Nos. 49 to 51 each are a mixture of Emulsion A 95% (containing rhodium salt) and Emulsion D 5% (free of rhodium salt).

As is apparent from the tables, according to the invention, the light-sensitive material is remarkably improved so as not to get its contrast characteristic degraded with time and well restrained from fogging during its storage after its coating. Samples Nos 53 and 54, which were prepared with the emulsion containing a non-inventive amount of silver iodide, are unacceptable because each of them produces an image little fogged, but the image contrast is deteriorated.

Further, the invention improves the light-sensitive material's safety to safelight so significantly as to facilitate the film handling in the darkroom.

What is claimed is:

1. A silver halide photographic light-sensitive material comprising:

a support having thereon at least one silver halide emulsion layer, said silver halide emulsion layer comprising a silver iodobromide grains containing silver iodide in an amount of 1.5 to 2.5 mol %, and at least one of spectral sensitizing dyes represented by formula 1 in an amount of 60 to 1000 mg per mol of silver halide being added during a course between process of desalting excessive salts and commencement of chemical ripening of said silver halide emulsion;

and a rhodium salt in an amount of $1\times10^{-10}$ to $1\times10^{-9}$ mol per mol of silver halide being added during the course between process of the desalting excessive salts and the commencement of the chemical ripening of said silver halide emulsion, Formula 1

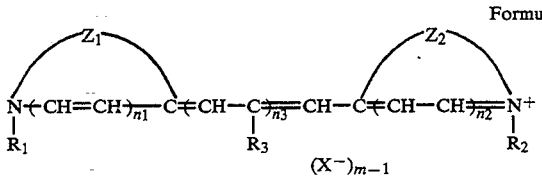

wherein $Z_1$ and $Z_2$ represent groups of non-metalic atoms necessary to form a pyrroline ring, a thiazoline ring, a thiazole ring, a benzothiazole ring, a naphthothiazole ring, a selenazole ring, a benzoselenazole ring, a naphthoselenazole ring, an oxazole ring, a benzooxazole ring, a naphthooxazole ring, an imidazole ring, a benzimidazole ring or a pyridine ring which each is either unsubstituted or substituted with a halogen atom, a lower alkyl group, a lower alkoxy group or a phenyl group; $R_1$ and $R_2$ each represent a lower alkyl group, a hydroxyalkyl group, a carboxylalkyl group or a sulfoalkyl group; $R_3$, when $n_3$ is 1, represents a lower alkyl group or a hydrogen atom, while, when $n_3$ is zero, represents a hydrogen atom; $n_1$ and $n_2$ each is 0 or 1; $n_3$ is 0 or 1; $X^-$ is an anion; and m is 1 or 2.

2. The material of claim 1 being X ray film.

* * * * *